US006093880A

United States Patent [19]

Arnalds

[11] Patent Number: 6,093,880

[45] Date of Patent: Jul. 25, 2000

[54] SYSTEM FOR PRIORITIZING AUDIO FOR A VIRTUAL ENVIRONMENT

[75] Inventor: Eythor Arnalds, Reykjavik, Iceland

[73] Assignee: Oz Interactive, Inc., San Francisco, Calif.

[21] Appl. No.: 09/084,247

[22] Filed: May 26, 1998

[51] Int. Cl.[7] ..... A63J 17/00

[52] U.S. Cl. ..... 84/464 R; 84/600; 84/645

[58] Field of Search ..... 84/464 R, 645, 84/600

[56] References Cited

U.S. PATENT DOCUMENTS

| | | | |
|---|---|---|---|
| 5,478,968 | 12/1995 | Kitagawa et al. . | |
| 5,513,129 | 4/1996 | Bolas et al. . | |
| 5,541,354 | 7/1996 | Farrett et al. | 84/603 |
| 5,585,587 | 12/1996 | Inoue et al. . | |
| 5,696,834 | 12/1997 | Kitagawa . | |
| 5,734,119 | 3/1998 | France et al. . | |
| 5,763,800 | 6/1998 | Rossum et al. | 84/603 |
| 5,811,706 | 9/1998 | Buskirk et al. | 84/605 X |
| 5,862,229 | 1/1999 | Shimizu . | |

*Primary Examiner*—Jeffrey Donels
*Attorney, Agent, or Firm*—Venable; John W. Schneller; Michael A. Sartori

[57] ABSTRACT

An audio language is used to generate audio sources for an audio scene. The audio sources are patterns comprising other patterns, composed music, audio samples, instruments, MIDI instruments, and filters. The audio files can be located on a computer-readable medium or accessible over a network. An audio player is provided for executing audio sources contained in audio files having code segments for the audio sources written in the audio language. The audio player prioritizes the audio sources according to prioritization reserved variables of the audio language to determine an order of priority. The audio player executes the audio sources according to the order of priority by transferring, playing, storing, or any combination of transferring, playing, and storing the audio sources according to the order of priority of the audio sources. The audio language and the audio player are advantageously useful for executing audio sources for an audio scene in a virtual environment.

32 Claims, 9 Drawing Sheets

PATTERN 100

| | |
|---|---|
| 1 | AUDIO EVENT(S) |
| 2 | OPTIONAL RESERVED VARIABLES:<br>AUDIO SOURCE ("S")<br>VOLUME ("V")<br>PAN ("P")<br>NOTE ("N")<br>PITCH<br>LENGTH OF NOTE OR REST ("I")<br>TEMPO ("T")<br>ARTICULATION ("A")<br>FREQUENCY MODULATION ("F")<br>WAVEFORM MODULATION ("W")<br>ON<br>OFF<br>BAR<br>BEAT<br>RANGE<br>MODULATION ("MOD")<br>METER<br>LOOP<br>PRIORITY ("P")<br>LEVEL OF LOADING ("LOL")<br>LEVEL OF STORING ("LOS")<br>LEVEL OF QUALITY ("LOQ")<br>POSITION ("POS") |
| 3 | OPTIONAL USER-DEFINED VARIABLE(S) |

FIG. 1

SAMPLE 101

| | |
|---|---|
| 5 | FILE NAME ("FILE") |
| 6 | OPTIONAL RESERVED VARIABLES:<br>BASE NOTE ("BASE")<br>RELEVANCY ("R")<br>LOOP POINTS ("LOOP") |

FIG. 2

INSTRUMENT 102

| | |
|---|---|
| 10 | SAMPLE(S) |
| 11 | OPTIONAL RESERVED VARIABLES:<br>BOTTOM ("BOTTOM")<br>TOP ("TOP")<br>SENSITIVITY ("SENS")<br>ATTACK, SUSTAIN, AND RELEASE ("ASR")<br>VOLUME ("V")<br>PAN ("P")<br>FREQUENCY MODULATION ("F")<br>WAVE DATA MODULATION ("W") |
| 12 | OPTIONAL MODULE(S) (USER-DEFINED VARIABLES) |

MIDI INSTRUMENT 103

| | |
|---|---|
| 20 | MIDI DEVICE ID ("DEVICE") |
| 21 | MIDI CHANNEL NUMBER ("CHANNEL") |
| 22 | MIDI PROGRAM NUMBER ("PROGRAM") |
| 23 | OPTIONAL RESERVED VARIABLES:<br>VOLUME ("V")<br>PAN ("P") |

SCENE 104

| | |
|---|---|
| 25 | AUDIO FILE ("FILE") |
| 26 | OPTIONAL RESERVED VARIABLES:<br>AUDIO START ("START")<br>TEMPO ("T")<br>SWING |

SYSTEM FOR PRIORITIZING AUDIO FOR A VIRTUAL ENVIRONMENT

The right of priority of U.S. Provisional Application Serial No. 60/050,921, filed May 27, 1997, is hereby claimed, and said application is herein incorporated by reference.

BACKGROUND OF THE INVENTION

The present invention relates generally to the playback of audio using a general purpose computer.

There have been several attempts to distribute and communicate audio information in digital form, such as the Musical Instrument Digital Interface ("MIDI") and the Modular File Format ("MOD"). Each of these prior attempts, however, produces a format designed for a specific purpose, and none of them can distribute audio in a flexible, dynamic, and efficient way over a network. Furthermore, none of these prior attempts has addressed real-time three-dimensional audio sound.

MIDI was designed by manufacturers of electronic musical instruments as a digital communication standard between such instruments. Consequently, MIDI was first and foremost designed by and for the narrow market of the music industry, and not for a much wider market, such as the entertainment market or the communication market.

Initially, MIDI was used primarily for communication between digital musical instruments, such as synthesizers and drum machines. Later, as these instruments became more and more computer oriented, MIDI became increasingly used for communication between digital instruments and computers. This evolution gave rise to a wide range of software tools for handling MIDI information, such as the so-called sequencer programs which basically provide functions for recording, editing, and playback of MIDI data. The increased use of MIDI by computers created a need for a convenient file format for exchanging MIDI data between such computers. For this purpose, the standard MIDI file format was created and is widely used today.

The main advantages of MIDI are low memory usage, relatively simple and small specification, and wide acceptance. As a result, the MIDI standard is well suited for low cost implementation because it tends to require few resources.

The disadvantages of MIDI are many and are mostly due to the essentially linear format of MIDI, which incorporates little knowledge about the actual musical or acoustical content of the material. MIDI works exclusively with control information consisting of event triggering messages and does not use any information about the actual audio signal itself, except for being able to transmit a number which has been assigned to a sound bank in a particular sound device. The lack of the ability to store intelligent knowledge using the standard MIDI file format also makes MIDI inadequate for use as a format to store musical knowledge and as a description of dynamic audio.

Conventionally, an audio event can sound quite different from one computer to another depending on the type of hardware (e.g., sound cards) being used for audio playback. For example, most sound cards have a synthesizer with pre-defined sound banks which differ in quality and nature from one sound card to another. Non-limiting examples of conventional sound cards include: the Soundlaster 16 sound card manufactured by Creative Technology of Singapore; and the AWE32 and the AWE64 sound cards manufactured by Creative Technology Ltd. of Singapore. To play the audio stored in the sound card's synthesizer, MIDI is often used because of its standard communication language for music events. MIDI permits transmission of audio event signals but does not permit transmission of audio samples. With MIDI, there is no indication as to what the audio output will sound like because of the dependence on the synthesizer to which the MIDI signal is sent.

MOD, which was originally developed for the Amiga computer manufactured by Commodore, and which was extended to other computers, distributes instrument audio files. These audio files include associated event data and primarily include note on and off information. MOD is primarily a file format and is not a communication standard. MOD files are basically a hybrid between audio sample data files (e.g., the .wav file format) and audio sequence data files (e.g., MIDI control event files).

MOD files are useful for distributing the same sounding audio data from one platform to another without requiring as much memory as one large pure audio data file. MOD files, for example, are useful for distributing audio demonstrations more efficiently than a pure audio data file and are more reliable in terms of sound result than MIDI.

MOD advantageously provides for storage of more musical content knowledge than formats which either store only audio (e.g., the .wav file format) or only events (e.g., the standard MIDI file format). MOD also provides a better way for describing audio than MIDI files. Although MIDI can only describe audio with tracks, MOD can describe audio with both tracks and patterns. Patterns can be used to generate audio phrases, which are created once, used many times, and make economical use of both audio and event data.

The main disadvantage of MOD is that, although it has a richer format than MIDI, it is still, like MIDI, static and linear. Although MOD files are much smaller than pure audio data files, MOD files are relatively huge compared to most MIDI files because there is no way to separate the audio data from the event data. Further, MOD is neither a clearly defined nor well established standard because many different varieties of MOD are used and required for different audio players. Moreover, MOD is not as widely accepted and distributed as the MIDI standard.

To deliver audio over the Internet, there are currently numerous technologies which can be used. These products today send broadcasts of live radio stations and music samples to any Internet user. Current audio compression technology is able to send FM quality music in real time to any Internet user who has a reasonably fast modem (e.g., 14.4 Kb or 28.8 Kb). With an ISDN line or better, it is possible to receive compact disk ("CD") quality music. Bandwidth, however, is a limiting factor to distributing audio over the Internet, at least until the latest 56.6 Kb modem becomes widely available.

To transmit audio over the Internet, Real Audio and Liquid Audio are products currently available. Real Audio by Real Networks of Seattle, Wash., is the most popular audio streaming software for distribution of real time audio over the Internet today. It is used, for example, by the American Broadcasting Company ("ABC") and the Cable News Network ("CNN") to send live news over the Internet. With Real Audio, it is also possible to listen to radio stations from all over the world. The latest version can deliver broadcast quality stereo sound to 28.8 Kb modems and near CD quality sound to ISDN and LAN connections. The latest Real Audio player also supports Real Video, a technology which uses fractal based technology to send streaming video at 10 fps over ISDN connections. For more information, see http://www.realaudio.com and http://www.timecast.com.

The main disadvantages of Real Audio are that it is a noninteractive format that does not guarantee quality, and it is bandwidth expensive, especially for higher quality.

Liquid Audio, manufactured by Liquid Audio of Redwood City, Calif., consists of three products: mastering software; server software; and playback software. Liquid Audio should solve some significant problems in the commercial delivering of music over the Internet because it uses a two-layer protection mechanism. As the first layer, the purchased audio is encrypted so that it can only be played back on a computer having de-encrypting software. The second layer of Liquid Audio uses a digital watermarking technology that identifies the purchaser of the piece of audio. The second layer of protection is used if the first layer of protection is penetrated. The Liquid Audio software uses compression technology from Dolby Laboratories, Inc. of San Francisco, Calif., to deliver CD quality music. The Liquid Audio format also has support for graphics, lyrics, linear notes, and production information. For more information, see http://www.liquidaudio.com.

The main disadvantages of Liquid Audio are that it is noninteractive and essentially not real-time. Further, Liquid Audio is mainly an anti-piracy format.

SUMMARY OF THE INVENTION

It is an object of the present invention to provide an audio language and an audio player for use in playing audio in a virtual environment and for transmitting audio data over a network.

It is a further object of the present invention to provide an audio language and an audio player for sequencing audio data through prioritization of individual sounds for downloading, playing, and storing of the audio data.

It is an additional object of the present invention to use limited bandwidth and memory efficiently and economically for producing audio by combining pre-recorded and dynamically created sounds.

Another object of the present invention is to provide an audio language and an audio player for producing audio using any general purpose computer.

It is another object of the present invention to provide a dynamic and appealing audio scape for a virtual environment.

It is yet another object of the present invention to provide an audio player for prioritizing and transferring, playing, storing, or any combination of transferring, playing, or storing audio data.

The above objects and advantages of the present invention are achieved by a method, an apparatus, and an article of manufacture for sequencing audio data in a virtual environment. The article of manufacture comprises a computer-readable medium embodying code segments and describing an audio source of an audio scene according to an audio language. The code segments comprise a first code segment for describing audio in the audio source of the audio scene, and for dynamically evolving the audio scene, and a second code segment for determining a priority of execution of the audio source within the audio scene.

Further, the method comprises generating audio for an audio scene having a plurality of audio sources, and determining the plurality of audio sources within the audio scene, as well as prioritizing the plurality of audio sources within the audio scene to obtain a priority of audio sources, and executing the plurality of audio sources according the priority of audio sources.

Still further, the apparatus of the invention comprises an apparatus for generating audio for an audio source of an audio scene, and an audio file for describing the audio source of the audio scene in an audio language and a priority of the audio source within the audio scene, the audio file being stored on a computer-readable medium. The apparatus also comprises an audio player for accessing the audio file, for determining a priority of audio sources within the audio scene by using the priority of the audio source, and for executing the audio file according to the priority of audio sources within the audio scene.

Moreover, the above objects and advantages of the present invention are illustrative, and not exhaustive, of those which can be achieved by the present invention. Thus, these and other objects and advantages of the present invention will be apparent from the description herein or can be learned from practicing the invention, both as embodied herein and as modified in view of any variations which may be apparent to those skilled in the art.

BRIEF DESCRIPTION OF THE DRAWINGS

The invention will be described in greater detail below by way of reference to the accompanying drawings, wherein similar reference characters refer to similar referenced parts throughout the drawings.

FIG. 1 illustrates a data structure for a pattern in the audio language of the present invention.

FIG. 2 illustrates a data structure for a sample in the audio language of the present invention.

DETAILED DESCRIPTION OF THE INVENTION

Figures 3A, 3B:
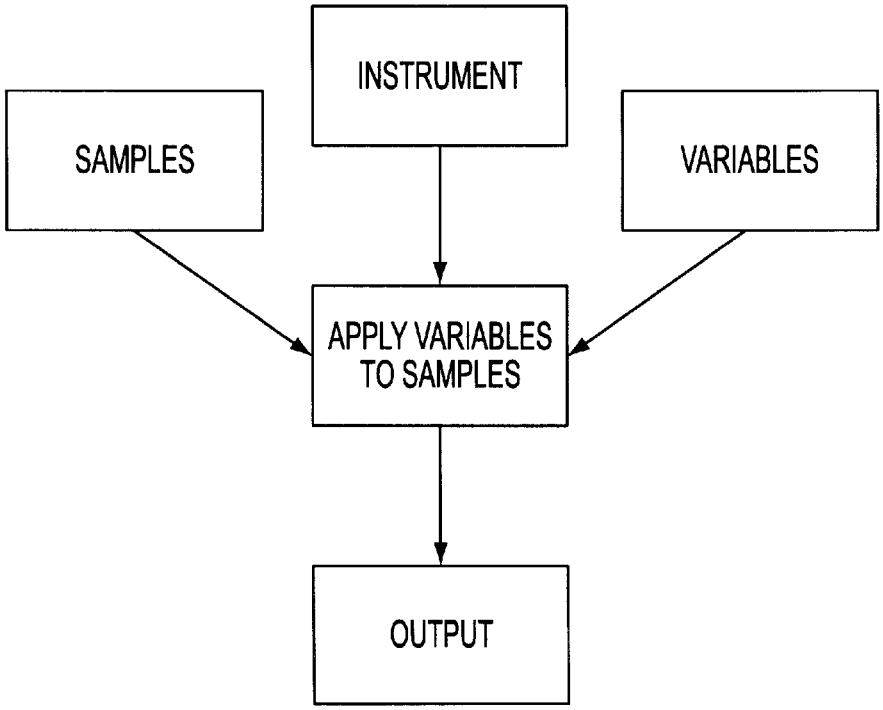
FIG. 3A illustrates a data structure for an instrument in the audio language of the present invention.
FIG. 3B illustrates a flowchart for an instrument.

After reciting several definitions, the present invention is described with respect to the audio language of the present invention and then with respect to the audio player of the present invention.

Definitions

In describing the present invention, the following definitions are applicable throughout:

"Audio" refers to any sound, such as music, speech, or a special effects sound, generated synthetically, such as by an electronic instrument or a general purpose computer, or non-synthetically, such as by a musical instrument or a human.

"Audio sample" refers to a digital sample of audio.

"Audio information" refers to characteristics, such as volume, pitch, and timing, of audio or an audio sample. As a non-limiting example, audio information can be described using a parameter or a variable in an audio language.

"Audio data" refers to information describing audio. Audio data can include audio samples and audio information. "

Audio language" refers to a computer programming language for describing audio and understandable by a general purpose computer. "

Audio file" refers to a computer-readable file accessible by a general purpose computer. An audio file comprises at least one of an audio sample, audio information, and audio data. For example, an audio file can comprise a plurality of audio samples and audio information concerning the audio samples. An audio file can be stored on a computer-readable medium available locally to a general purpose computer or accessible over a network.

A "virtual environment" refers to any three-dimensional graphics computer application, virtual reality computer application, or virtual computer environment. A virtual environment can be maintained by one or a plurality of general purpose computers.

An "audio scene" refers to the audio: within a scene of a virtual environment; within a scene of any computer application, such as a two-dimensional graphics computer application or a computer game, which can be maintained by one or a plurality of general purpose computers; or within any user interface, such as an operating system or the web page for an Internet site.

An "audio source" refers to a source for audio within an audio scene. Zero or more audio sources comprise an audio scene.

A "user" refers to a human interacting with a general purpose computer. For example, the user in a virtual environment refers to the human interacting within the virtual environment.

A "computer-readable medium" refers to an article of manufacture able to embody code segments for controlling a general purpose computer. Non-limiting examples of a computer-readable medium include: a magnetic hard disk; a floppy disk; an optical disk, such as a CD-ROM or one using the Digital Versatile Disc ("DVD") standard; a magnetic tape; a memory chip; a carrier wave used to carry computer-readable electronic data, such as those used in transmitting and receiving electronic mail or in accessing a network; and any storage device used for storing data accessible by a general purpose computer.

"Code segments" refer to software, instructions, computer programs, or any means for controlling a general purpose computer.

A"general purpose computer" refers to: a general purpose computer; an interactive television; a hybrid combination of a general purpose computer and an interactive television; and any apparatus comprising a processing unit, memory, the capability to receive input, and the capability to generate output. A general purpose computer using one or more computer-readable media can implement a virtual environment accessible by a user. One or more general purpose computers connected using a network and using one or more computer-readable media can implement a virtual environment accessible by one or more users.

"Network" refers to a system for connecting general purpose computers. Non-limiting examples of a network include: a local area network ("LAN"); a wide area network; a broad band network, such as that accessed by automatic teller machines ("ATMs"); and the Internet.

Audio Language

The audio language of the present invention provides an efficient and economic way to maximize limited bandwidth and computer memory by combining pre-recorded and dynamically created audio. Audio samples advantageously provide very accurate and platform independent reproduction of an original audio. Audio samples, however, require much memory, especially for an audio recording of substantial length, such as a musical phrase, a sequence, or an entire song. If the audio is, however, divided into basic units of pieces of audio, storing the audio samples using the small pieces of audio generally requires less memory than half of the original recording. This is a discovery of the inventor and the theory behind the audio language of the present invention.

With the audio language of the present invention, audio can be generated by using small fragments of the basic audio material (e.g., audio clips or files in the .wav file format) and by time scheduling and mixing the small fragments into larger units or whole songs.

An audio sample of a musical phrase usually contains much redundant information. For example, there might be drum hits which occur periodically or motives and chord patterns which recur in a piano part. If small audio fragments are used as the base material for the larger musical composition, the audio events represented by each audio fragment can be assembled and used in various creative ways. For instance, different songs can be assembled using the same basic audio material, or songs can be made to evolve in a dynamic way by modifying different variables (e.g., volume and pitch) in either determined ways (e.g., a pre-determined sequence) or non-determined ways (e.g., user interaction with the general purpose computer, or a random selection) According to the audio language of the present invention, audio can be generated using the audio samples and audio information of the recorded audio.

In addition, the audio language of the present invention is extendable and dynamic through the use of modulation and filtering. Further, audio can be created from existing audio through scripting audio data.

Moreover, with the audio language of the present invention, audio can be created by composing a musical score using notes, rests, and lengths of notes and rests.

With the audio language of the present invention, an instrument can be defined and used to generate audio. This ability provides the advantage of platform independence. With the present invention, the sound of any instrument sounds exactly the same regardless of the sound card used with the general purpose computer.

With the audio language of the present invention, audio can be generated using any combination of audio samples, audio information, composed audio, a user-defined instrument, a MIDI instrument, modulation, and filtering.

Further, by using the audio language of the present invention, an audio scene can be created and changed dynamically. For example, the audio scene can be changed by increasing the tempo in response to the number of listeners, or in response to positional information of the user in a virtual environment.

Instead of hearing static audio, which is always predetermined, the user can experience audio which evolves dynamically in perfect synchronization with the virtual environment.

The discussion of the audio language is next divided into patterns, sources, variables, and audio scenes.

Patterns

A "pattern" describes audio for an audio source of an audio scene. A pattern comprises one or more audio events and zero or more variables, and is used to organize audio into a basic building block. A pattern can be assembled in various ways. The audio of a pattern can be executed sequentially or simultaneously by a general purpose computer.

In FIG. 1, an exemplary data structure for a pattern 100 is illustrated. This data structure includes one or more audio events 1, and zero or more variables for the pattern 100. In a preferred embodiment, a variable can be either a reserve variable 2 or a user-defined variable 3.

If the audio of the audio event 1 is music, the audio event 1 in a preferred embodiment can be composed. Minimally, such a composition comprises a combination of notes, rests, and lengths of the notes and rests.

Notes are comprised of the letters "A" through "G" representing the traditional notes of the Western twelve-tone musical scale system, with an optional octave number from 0 through 8, and an optional flat # or sharp b appended to the note. Rests are represented by the silence instrument and denoted as "@."

A length of a note or a rest is represented by a fraction of a second and is scaled by tempo (e.g., 1/8 for eighth notes). A length value precedes the note or rest which it affects. If no length precedes a note or a rest, the current length value of the last length defined is used for all subsequent notes and rests until a new length is defined. The default length value is 1/4 (e.g., a quarter note).

Instead of using @ and a length value, predefined rest lengths, which do not affect the current length, can be used. In a preferred embodiment, these are whole, half, fourth, eighth, and sixteenth note rests, and are represented by =, –, ", ', and ~, respectively.

Further, the audio event 1 can comprise a pattern or several patterns arranged in a nested structure.

Moreover, the audio event 1 can comprise runtime code or a file path name for accessing a pattern from a computer-readable medium or from over a network.

The audio event 1 can also repeat the playback of audio. In a preferred embodiment, the * operator indicates that any audio data preceding the * operator should be repeated the number of times shown by the number following the * operator. If no number follows the * operator, the audio data is repeated indefinitely.

The audio event 1 can further randomly choose between the playback of audio data. In a preferred embodiment, the | operator between two or more audio data indicates that any one of the audio data is randomly chosen and executed. Further, weights can be assigned to bias the random selection.

The audio data comprising audio event 1 can be played sequentially or simultaneously. A space or line return between audio data indicates sequential play. A list of audio data separated by commas and ending with a semicolon indicates simultaneous play.

Start times and end times for sounds can be defined. In a preferred embodiment, this is accomplished by writing a pair of values with a colon between them, where the first value specifies the start time and the second value specifies the length.

Alternatively, time values can further be specified using absolute start times by writing the start time, followed by a dash, and followed by the stop time. As another alternative, MIDI time indications can be used. As a further alternative, the above time notations can be used interchangeably.

In a preferred embodiment, the audio language is not case-sensitive. Further, basic arithmetic calculations, such as addition, subtraction, multiplication, and division, can be performed within a pattern by enclosing the calculations within parentheses and using the symbols +, –, *, and /, respectively.

In summary, the audio event 1 can comprise any combination of the following: composed music; patterns; runtime code; and file path names. As discussed below, the audio event 1 can also comprise any combination of the above and the following: "sample"; "instrument"; "MIDIinstrument"; and "filter." Alternatively, other types of audio data can be included.

To illustrate the audio language of the present invention, consider the following two patterns, Verse and Chorus:

```
pattern Verse {
  C5 C5 G5 F5 E#5 D5 1/2 C5 * 2
}
```

and

```
pattern Chorus {
  G5 G5 G5 E5 G5 A5 1/2 G5 * 2
}
```

In both patterns, the notes are quarter notes by default, and the last note of each pattern is a half note. In both patterns, all notes are in the fifth octave. In the pattern Verse, the note "E#5" indicates the E flat note in the fifth octave. For both patterns, the string of notes are repeated two times because of the "* 2".

In the following two patterns Simple1 and Simple2, the ability to play sequential and simultaneous audio events is illustrated, where Verse and Chorus are defined patterns as in the two previous examples. The pattern Simple1 is as follows:

```
pattern Simple1 {
  Verse
  Chorus
}
```

In the pattern Simple1, the patterns Verse and Chorus are played sequentially in the order Verse, then Chorus. The sequential play is caused by the line return after Verse, which is used to separate the two patterns. Alternatively, the pattern Simple1 can be played sequentially by separating the patterns with a space as follows:

```
pattern Simple1 {
  Verse Chorus
}
```

Instead of playing the patterns Verse and Chorus sequentially as in Simple1, the patterns Verse and Chorus can be played simultaneously as in the pattern Simple2:

```
pattern Simple2 {
   Verse,
   Chorus;
}
```

In the pattern Simple2, the simultaneous play is caused by the comma after Verse and the semi-colon after Chorus. Alternatively, the pattern Simple2 does not require the line return after "Verse," and is equivalent to the following:

```
pattern Simple2 {
   Verse, Chorus;
}
```

To further illustrate patterns in the audio language of the present invention, consider the following pattern drums, where the patterns Kick and Snare are previously defined patterns as having audio data with a thump sound and a crash sound, respectively:

```
pattern drums {
   Kick Snare Kick Snare
}
```

For the above example, each pattern has a current note length, which initially defaults to a quarter note. The pattern sounds like thump, crash, thump, crash.

The current note length can be changed by writing a new value using classical notation (e.g., 1/16) or alternatively using MIDI beats and ticks (e.g., 0.15, where there are 240 ticks in a quarter note beat). In the example above, each instrument sound is one-quarter note long, and the whole pattern is four beats in length (i.e., one measure in 4/4).

The following example changes the first quarter note of the above example:

```
pattern drums {
   1/8 Kick Kick 1/4 Snare Kick Snare
}
```

For the above example, there are two kicks on the first beat, and the snare-kick-snare phrase receives the remaining three beats of the measure The result sounds like thump-thump, crash, thump, crash.

Using start times and length separated by a colon, the following example is equivalent to the preceding example:

```
pattern drums {
   Kick 0:1/8
   Kick 1/8:1/8
   Snare 1/4:1/4
   Kick 2/4:1/4
   Snare 3/4:1/4
```

In the above example, the absolute start times do not affect the current note length Because the default note length is 1/4, the current note length in the example above is and remains 1/4 throughout the whole pattern. Further, with absolute start times, the order of the audio events does not matter. For example, the following pattern is equivalent to the one above:

```
pattern drums {
   Kick 0:1/8
   Kick 1/8:1/8
   Kick 2/4:1/4
   Snare 1/4:1/4
   Snare 3/4:1/4
}
```

Moreover, with the audio language of the present invention, the instrument name does not need to be repeated. For example, the following pattern is equal to the above two examples:

```
pattern drums {
   Kick 0:1/8
   1/8:1/8
   2/4:1/4
   Snare 1/4:1/4
   3/4:1/4
}
```

In a preferred embodiment, blank spaces and returns do not matter. For example, the following is equivalent to the previous three examples:

```
pattern drums {
   Kick 0:1/8 1/8:1/8 2/4:1/4
   Snare 1/4:1/4 3/4:1/4
}
```

The same pattern can also be written using MIDI notation for time values:

```
pattern drums {
   Kick 0:0.120 0.120:0.120 2:1.0
   Snare 1:1 3:1
}
```

Writing the time as a start time, a dash, and a stop time, the following example below is equivalent to the previous five examples:

```
pattern drums {
   Kick 0–0.5
   Kick 0.5–1
   Snare 1–2
   Kick 2–3
   Snare 3–4
}
```

With the audio language of the present invention, the above six examples are equivalent patterns. Moreover, the above notations for time length can be mixed and matched arbitrarily to arrive at a desired pattern. For example, not specifying start times is convenient when manually editing a pattern.

The above examples deal with percussion. The following example plays the beginning of the song "Gamli Nöi" on a previously defined piano instrument:

```
pattern Gamli_Nöi {
    piano C3 C3 C3 E3 D3 D3 D3 F3 E3 C3 D3 B2 1 C3
}
```

All of the notes in the above example are quarter notes, except the last, which is a whole note.

If the octave number is dropped, the default octave is used and is the same as the last note which specified it. The following is equivalent to the above example:

```
pattern Gamli_Nöi {
    piano C3 C C E D D D F E C D B 1 C
}
```

In the audio language, rests are designated by @, which are the length of the current length value. In the following example, whole rests have been inserted into the song:

```
pattern Gamli_Nöi {
    piano C3 C C E 1 @ 1/4 D D D F 1 @ 1/4 E C D B2 1 C3
}
```

Using the predefined rest length "=" instead of "1 @", the above example is equivalent to the following:

```
pattern Gamli_Nöi {
    piano C3 C C E = D D D F = E C D B2 1 C3
}
```

As an additional example of simultaneous play, consider the following pattern Drums2:

```
pattern Drums2 {
    Kick Snare Kick Snare,
    1/8 HiHat HiHat HiHat HiHat HiHat HiHat HiHat HiHat;
}
```

In the above example, the eight HiHats can be shortened using the * operator as follows:

```
pattern Drums2 {
    Kick Snare Kick Snare,
    1/8 HiHat *8;
}
```

In the above example, the comma indicates that the next block should have the same start time as the current block. In this case, both "Kick Snare Kick Snare" and "1/8 HiHat *8" start at time zero. The semicolon indicates that the next block begins after the current block.

In using "," and ";", the current length value is reset to a quarter note. With this default value, "1/4", does not need to be written in front of the Kick on the fifth line of the following example:

```
pattern Drums2 {
    Kick Snare Kick Snare,
    @ Clap @ Clap,
    1/8 HiHat *3 @ HiHat *3 @;
    Kick Snare Kick Snare,
    Baseline;
}
```

In the first measure of the above example, the Kick and Snare are played on the first two beats and repeated on the second two beats. A clap sound occurs on the same beat as the snare. A high hat sound occurs on the first, second, third, fifth, sixth, seventh, and eighth notes, and a silence occurs on the fourth and eighth notes. In the second measure, the patterns Kick and Snare produce the same sound as in the first measure. A bass lick from a previously defined Baseline pattern accompanies the Kick and Snare patterns.

As another example, consider the following patterns major and minor:

```
pattern major {
    piano C3,
    piano E3,
    piano G3,
    note C3
}
pattern major {
    piano C3,
    piano Eb3,
    piano G3,
    note C3
}
```

A simple progression using the above major and minor patterns can be described as follows:

```
pattern progress {
    1 major C F minor A major C
}
```

The above pattern progress plays major C, major F, A minor, C major. The description of the music in the audio language of the present invention appears backwards, because it is customary to name the chord as "C major", not "major C".

Further, with the audio language of the present invention, patterns can be created which do not have a predetermined instrument or pattern. For example, consider the following patterns Gamli_Nöi and play:

```
pattern Gamli_Nöi (instrument instr) {
    (instr) C3 C C E D D D F E C D B2 1 C3
}
```

The following pattern play plays "Gamli_Nöi" using the piano instrument:

```
pattern play {
    Gamli_Nöi (piano)
}
```

To add randomness to the played audio, the | operator is used. For example, the following pattern randomly selects one of three baselines:

```
pattern random1 {
    BaseLine1_BaseLine2_BaseLine3;
}
```

Weights can be assigned to bias the random selection, where the default is equal weighing. For example, the following example weights the above example:

```
pattern random1 {
    BaseLine1 20%_BaseLine2 40%_BaseLine3;
}
```

In the above pattern random1, the weighting for the last random selection of BaseLine3 was not included. In a preferred embodiment, the weight of the last item in a list separated by the | operator is the remaining percentage after subtracting all the percentages of the previous items from 100%. In the above pattern random1, the percentage of the BaseLine3 is determined to be 40%.

With the audio language of the present invention, a "groove factor" setting can be employed. Namely, a slight delay on certain sixteenth notes can be programmed.

As will become apparent to those of ordinary skill in the art, the audio language of the present invention can be used to create many different sounds and audio processing techniques by modulating values of all parameters allowed by other parts of the system.

Audio Sources

In a preferred embodiment, all audio events within a pattern are executed according to the current audio source, which is specified by the reserved variable audio source ("s"). Because the default audio source is silence, the current audio source must be set before an executed audio event can be heard. The current audio source is in effect from the first audio event with which it was associated until the next audio event where a different audio source is defined. A change in the current audio source can be inserted anywhere between the audio events.

In a preferred embodiment, audio sources can be one of the following five: a "pattern"; a "sample"; an "instrument"; a "MIDIinstrument"; and a "filter."

For a "pattern," the pattern is nested within another pattern. This nesting of patterns can occur without limit. In the following example, the pattern Simple1 calls the patterns Verse and Chorus and uses these two patterns as audio sources:

```
pattern Simple1 {
    Verse
    Chorus
    Verse
}
```

A second audio source is a "sample." For a sample, the audio event preferably uses audio files of binary audio samples. In FIG. 2, an exemplary data structure for a sample 101 is illustrated and includes entries for the file name ("file") 5 and optional reserve variables 6 for the base note ("base"), the relevancy ("r") , and the loop points ("loop").

The file name ("file") 5 specifies the audio file of audio samples. The file name ("file") 5 can be the name of a local audio file, a uniform resource locator ("URL"), a file in the wav format, a file in the .MP2/3 format, an audio file from a library, or any audio file of audio samples.

The base note ("base") sets the original pitch. The relevancy ("r") sets the priority of playback for the sample 101. The loop points ("loop") specify the start time and end time of the loop. The start and end times can be in absolute time or MIDI time.

Because the base note ("base"), the relevancy ("r"), and the loop points ("loop") have default settings for samples, these reserved variables are optional and can be excluded from the data structure for sample 101. In a preferred embodiment, the base note ("base") defaults to C4. The relevancy ("r") defaults to 100, which is the highest priority. The loop points ("loop") defaults to "0 0", which indicates that no looping will occur because the start loop point and the end loop point are the same.

The sample 101 can further specify a note to be sampled. In a preferred embodiment, a note is not specified in the sample, and the sample is never pitch-shifted, which is useful for defining percussion sounds. Additionally, other effects can be applied to the sample, such as reverberation, low-pass filtering, high-pass filtering, band-pass filtering, and additive noise. In a preferred embodiment, these effects are applied using a filter, which is described below.

As an example of a sample sound source, consider the following:

```
sample SmallBrook {
    file Brook.wav
    base C4
    r 80
    loop 45 23345
}
```

In the above example, the audio file Brook.wav in the .wav file format is sampled with a base pitch of C in the fourth octave. The sample SmallBrook has a relevancy of 80. The sample is looped beginning at absolute time 45 and ending at absolute time 23345.

A third audio source is an "instrument." For an instrument, the data structure comprises an organized set of audio samples, attributes which are applied to individual audio samples, and playback parameters which are applied to the instrument as a whole. Within each instrument, a number of external modules, such as audio signal modules, can be connected to the playback parameters and interconnected with each other.

In FIG. 3A, an exemplary data structure for an instrument 102 is illustrated, and includes entries for: one or more samples 10; optional reserved variables 11 for the bottom ("bottom") of a pitch range for the instrument 102, the top ("top") of the pitch range, the sensitivity ("sens"), the attack, sustain, and release ("asr"), the volume ("v"), the pan ("p") the frequency modulation ("f"), and the wave data modulation ("w") ; and zero or more modules 12. In FIG. 3B, a flowchart of an instrument is illustrated.

The sample 10 identifies one or more samples of the type of sample 101 in FIG. 2. Each sample has three optional attributes for the range of the sample: bottom ("bottom"), top ("top"), and sensitivity ("sens"). The attack, sustain, and release ("asr") defines the attack, sustain, and release for the instrument. The volume ("v") sets the volume for the sample. The pan ("pan") sets the relative volume between left and right audio channels of the sample. The frequency modulation ("f") sets the frequency of the sample. The wave modulation ("w") sets the amplitude of the sample. The module 12 identifies zero or more external modules for playback with the instrument. The module 12 can be shared between instruments.

In a preferred embodiment, an instrument 102 can minimally be defined using a sample 10. The reserved variables 11 are optional, and, if not named in the instrument, default values for the reserved variables are used. Because the reserved variables 11 are created for each instrument, the reserved variables 11 are referred to either in the patterns which use the instrument or in the variables of the modules 15.

Each sample 10 of the instrument 102 has three optional attributes which define the pitch range in which the sample should be played and which define the velocity sensitivity of the sample (i.e., how much velocity is needed to evoke it). In a preferred embodiment, the reserved variables bottom ("bottom"), top ("top"), and sensitivity ("sens") are reserved within the instrument 102 for defining the bottom of the pitch range, the top of the pitch range, and the velocity sensitivity, respectively, of the sample 10. A note following the reserved variables bottom ("bottom") and top ("top") indicates, respectively, the bottom and top of the pitch range. The defaults for bottom ("bottom") and top ("top") are infinite. A numerical value in the range of 0% to 100% following the reserved variable sensitivity ("sens") indicates the velocity sensitivity.

The default for sensitivity ("sens") is 50%.

As an example of an instrument, consider the following:

```
instrument CoolInst {
    sample CoolHi
        bottom A6
        top E7
    sample CoolMid
        bottom G5
        top G#6
    sample CoolLow
        bottom F#5
        sens 60
    module LFO (freq int)
    module filter (cutoff)
}
```

In the instrument CoolInst, the sample CoolHi has a pitch range between A6 and E7, the sample CoolMid has a pitch range between G5 and G#6, and the sample CoolLow has a pitch range between F#5 and infinity with a sensitivity of 60. The variables "freq", "int", and "cutoff" are user-defined variables, which are discussed below. The module LFO is a component that is used to control the frequency of the samples in the instrument by varying it in sync with a low frequency waveform. The module filter is a component that is used to control the frequency distribution of the samples in the instrument.

As another example of an instrument, consider the following:

```
instrument Riff {
    sample http://www.oz.inc./soundlib/guitars.ozl::"DirtyRiff"
    note C3
}
```

For the instrument Riff, the instrument executes the note C3 according to the audio file "DirtyRiff" accessed from the Internet.

Because multiple samples can be specified within an instrument, a single sample does not need to be pitch-shifted across the entire spectrum. Consider the following example of another instrument:

```
instrument piano {
    sample http://www.oz.inc./soundlib/piano__c2.mp3 note C2
    sample http://www.oz.inc./soundlib/piano__c2.mp3 note C3
    sample http://www.oz.inc./soundlib/piano__c2.mp3 note C4
}
```

In the above instrument piano, the instrument samples the notes C2, C3, and C4 according to the audio file "piano__c2.mp3" accessed from the Internet.

With the present invention, three-phrase sounds, for example attack, sustain, and release, can be specified so that a piano note, for example, may be struck and then sustained while fading away, with a barely audible soft click at the release In a preferred embodiment, attack, sustain, and release are indicated using the reserved variable "asr" in the instrument 102 followed by three values for specifying the attack, sustain, and release. For example:

```
instrument piano {
    sample http://www.oz.inc./soundlib/pianos.ozl::piano__c2
    asr 9640 17820 0.2
    note C2
}
```

For the above instrument piano, the instrument samples the note C2 according to the audio file "piano__c2" accessed from the Internet, and the variable "asr" defines the attack, sustain, and release. In particular, the attack is from sample 0 to 9640, the sustain is looped from sample 9641 to 17820, and the release is from sample 17820 to the end of the sample. The sustain is faded out linearly 20% every sound.

In the audio language of the present invention, because instruments are an audio source, an instrument is not audible unless it is used in a pattern. Consider the following example:

```
instrument Kick {
    sample "Kick.wav"
}
instrument Snare {
    sample "Snare.wav"
}
```

-continued

```
instrument HiHat {
    sample "ClosedHat.wav"
}
```

The above instruments Kick, Snare, and HiHat create percussion sounds from three sampled files using defaults for the reserved variables volume, pan, frequency modulation, and wave data modulation. With the first two instruments, the following pattern can be created:

```
pattern drums {
    Kick Snare Kick Snare
}
```

The above pattern drums generates a classic rock 'n' roll drum pattern, which sounds like thump, crash, thump, crash.

Figures 4A, 4B, 5:
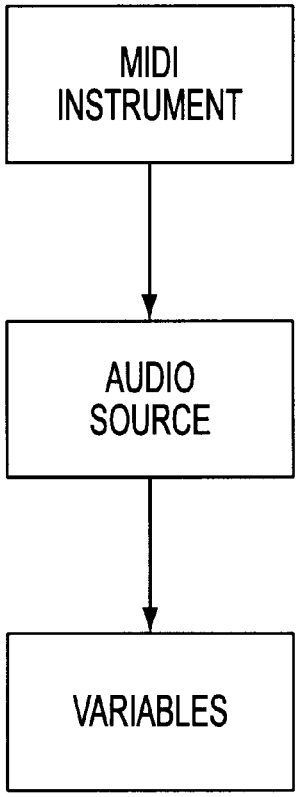
FIG. 4A illustrates a data structure for an MIDI instrument in the audio language of the present invention.
FIG. 4B illustrates a flowchart for an MIDI instrument.
FIG. 5 illustrates a data structure for a scene in the audio language of the present invention.

A fourth audio source is a MIDI instrument. For a MIDI instrument, the audio source uses a general MIDI compliant synthesizer device. In FIG. 4A, an exemplary data structure for a MIDI instrument 103 is illustrated, and includes entries for: the MIDI device ID ("device") 20; the MIDI channel number ("channel") 21; the MIDI program number ("program") 22; and optional reserved variables for the volume ("v") and the pan ("p").

The reserved variables volume ("v") and pan ("pan") function the same as volume ("v") and pan ("pan") for the instrument 102 as discussed above. If the reserved variables volume ("v") and pan ("pan") are not specified in the MIDI instrument 103, the default values of the variables are 50%.

In FIG. 4B, a flowchart illustrates how MIDI channel information affects variables.

In addition to the above audio sources, synthesis can be used as a fifth audio source. Further, filters can be used to process patterns as well as instruments.

As an example of a filter as an audio source, consider the following filter jitter, which takes any pattern and warps the pattern.

```
filter jitter {
    guid {12344578-1234-1434-1264-1134}
        http://www.oz.com/modules/filt2.dll
    jitterfreq 56
    jitterpitch 26
}
```

The parameter guid is used to identify the filter module. The Internet address "http://www.oz.com/modules/filt2.dll" is used to specify the location of the filter module. The parametersjitterfreq and jitterpitch are used to specify how the filter should operate.

With the above filter jitter, a pattern can be filtered. For example,

```
pattern jitter_drums {
    drums *2 -> jitter
}
```

The above pattern jitter_drums plays the pattern drums through the jitter filter.

As an alternative, a filter can receive audio from a pattern or an instrument. For example, consider the following filter echo, which creates two fainter delayed copies of the input:

```
filter echo {
    guid {13364378-1267-2454-1166-2134}
        http://www.oz.com/modules/filt1.dll
    freq 25
}
```

The above filter echo creates a filtered replica and an echo of the audio source. The above filter echo is used in the following pattern:

```
pattern helter_skelter {
    echo -> jitter
}
```

In the above pattern helter_skelter, the filter echo generates notes, which are then input into the filter jitter. The output of the filter jitter is input into the filter scramble. Alternatively, instead of the filter echo, a static pattern (e.g., drums) could replace the filter echo for generating the audio data.

A filter of the present invention can be coded in any Component Object Model ("COM") supported computer language, such as C++, Java, and Delphi.

In a preferred embodiment, a filter does not perform digital signal processing on a sample-by-sample basis, but instead uses pitch and timing data to process the filter input. Alternatively, a filter of the present invention can perform digital signal processing on a sample-by-sample basis.

Variables

In addition to having patterns and audio sources, the audio language of the present invention also has variables, which can be either reserved variables or user-defined variables. Variables are used to define attributes and can vary over time (i.e., they can be modulated).

Reserved variables are pre-defined for certain audio attributes. In a preferred embodiment, the reserved variables 2 in pattern 100 include, among others, the following: audio source ("s"), volume ("v"), pan ("p"), note ("n"), pitch, length of a note or a rest ("l"), tempo ("t"), articulation ("a"), frequency modulation ("f"), and waveform modulation ("w"). When a reserved variable is not specified, the variable's default is used.

The audio source ("s") defines the audio source for a pattern. As explained above, the audio source can be a pattern, a sample, an instrument, a MIDI instrument, a filter, a file path name, a URL, or any other designation of an audio source. The default audio source is the previously defined audio source. If no audio source is previously defined, the default audio source is silence.

The volume ("v") refers to the level of audio sample and is within the range of 0 to 127. The default value of volume ("v") is 127.

The pan ("p") refers to the relative distribution between right and left audio channels and is within the range of −64 to 64. The default value of pan ("p") is 0.

The note ("n") is in the range from C0 to C11, where A6 is 440 Hz with a variation of +/−100 cents between 1/2 steps. The default note is C4.

The pitch ("n") is an offset of the playback speed, and for the playback of audio data, the audible pitch is modulated using the reserved variable pitch. The default pitch is A 440.

The length ("l") is a fraction of a second and can be defined using "X/Y" where X and Y are integers. The default length is 1 second.

The tempo ("t") refers to the tempo, and is a value between 0 and 256 beats per minute. The default tempo is 120.

The articulation ("a") is a percentage of the original length and has a value between 0.0 and 1.0. The default articulation is 0.5.

The frequency modulation ("f") refers to low frequency oscillator and is between 0.01 Hz and 1 kHz. The default frequency modulation is 1 Hz.

The waveform modulation ("w") refers to the type of wave and is a module dependent variable. The default waveform modulation is a sine wave.

The reserved variables volume ("v"), pan ("p"), frequency modulation ("f"), and waveform modulation ("w") are reserved variables used with the instrument audio source and are either defined within the instrument itself or are used in connection with the current instrument.

As an example of using samples, instruments, reserved variables, and patterns, consider the following:

```
sample CoolHi {
  file CoolHi.wav base C7
}
sample CoolMid {
  file Cool.wav base C5
}
sample CoolLow {
  file CoolLow.wav base C4
}
```

For the above example, the sample CoolHi samples the audio file CoolHi in the .wav file format using the base note C7, the sample CoolHi samples the audio file CoolMid using the base note C5, and the sample CoolLow samples the audio file CoolHi in the .wav file format using the base note C4.

The following instrument CoolInst uses the samples CoolHi, CoolMid, and CoolLow defined above.

```
numvar int
numvar cutoff
instrument CoolInst
  sample CoolHi bottom A6 top E7
  sample CoolMid bottom G5 top G#6
  sample CoolLow top F#5 sens 60
  module LFO (freq int)
  module Filter (cutoff)
}
```

In the above example, the instrument CoolInst samples the sample CoolHi in the pitch range from A6 to E7, samples the sample CoolMid in the pitch range from G5 o G#6, and samples the sample CoolLow in the pitch range from F#5 to infinite with a sensitivity of 60. The variables "freq", "int", and "cutoff" are user-defined variables, which are discussed below.

As an example using the reserved variables volume and pan, consider the following:

```
pattern drums {
  kick snare kick snare,
  v 0 90,
  pan −16 16;
}
```

In the above pattern, the drums are faded in during four beats while the sound is panned from extreme left to extreme right.

Alternatively, the transition times can be explicitly specified for volume and pan. For example, the above example can be changed as follows:

```
pattern drums
  kick snare kick snare,
  v 0 90 2,
  pan −16 16 1 2;
}
```

The above example directs the fade-in in two beats, and the pan in one beat starting with beat two.

In addition to the above reserved variables, the following reserved variables 2 are defined for pattern 100: on, off, bar, beat, range, modulation ("MOD"), and meter. For the audio event 1 in the pattern 100, the length that the audio event is played can be set with the reserved variables "on" and "off." Both of these reserved variables can be specified with either a relative time (e.g., bar or beat) or absolute time (e.g., no bar/beat reference). The default on and off parameters are off.

The reserve variables bar and beat refer to the relative time positions of the audio event. The default bar and default beat are 4/4 and quarternote, respectively.

The reserved variable range refers to the active range of the audio event. The default range is infinite.

The reserved variable modulation ("mod") refers to the modulation of a reserved variable by a user-defined variable, an external input, or a randomly generated variable. The default modulation is none.

The reserved variable meter refers to the fraction of beats, such as 4/4, 2/16, or 12/2. The default meter is 4/4.

The audio event 1 in pattern 100 can also be looped using additional reserved variables. For example, the reserved variable "loop" refers to the number of times that the audio event is looped. If the reserved variable loop is missing or is set to 0 or 1, the audio event is played once. If the reserved loop is set to a number greater than 1, the audio event is looped for that number of times.

In addition to the above reserved variables, the following five reserved variables 2 are defined for pattern 100: priority ("p"), level of loading ("lol"), level of storing ("los"), level of quality ("loq"), and position ("pos"). When the pattern 100 is used with an audio scene, these five reserved variables can be used to prioritize the audio sources of the audio scene.

The priority ("p") refers to all variable parameters. The priority is defined as a percentage value between 0 and 100 and defaults to 50%.

The level of loading ("lol") refers to the priority of a pattern for loading or preloading the pattern from a computer-readable medium. When choosing between two actions, the one with the higher priority is chosen, as discussed below in the "Audio Player" section. The level of loading has values between 0% and 100% and defaults to a value of 50%.

The level of storing ("los") refers to the priority of a pattern for storing the pattern on a computer-readable medium. When choosing which of two patterns to store, the one with the lower "los" is discarded. The level of storing has values between 0% and 100% and defaults to a value of 50%.

The level of quality ("loq") refers to the quality of the pattern. When system resources do not allow the playback of two high quality samples, the one with the lower "loq" is played in lower quality. The level of quality has values between 0% and 100% and defaults to a value of 50%.

The position ("pos") refers to the coordinates of the pattern as an audio source within an audio scene. In a preferred embodiment, the coordinates are Cartesian coordinates. The position of the pattern can be fixed, scripted with a prerecorded path, or modulated by the audio scene, the user's interaction with the audio scene, or a variable using interpolation between positional coordinates within the audio scene. The position has values of 0 to infinity and defaults to a value of infinity.

In addition to reserved variables 2, the pattern 100 comprises user-defined variables 3. User-defined variables are used to refer to any numerical representation of an audio attribute which can vary over time. With a user-defined variable, the functionality of the variable is not predetermined, as with the reserved variables, but is defined by the programmer. User-defined variables are declared by using the keyword "variable" followed by the name of the variable. User-defined variables can use values from reserved variables and vice versa. As an example of a user-defined variable, consider the user-defined variable vVol in the following pattern:

```
pattern VarVolume2 {
   variable vVol
   vVol 64
   v vVol
   Melody *2
}
```

In the above example, the previously defined pattern Melody is played twice at a volume of 64. The volume is set with the user-defined variable vVol.

In a preferred embodiment, other user-defined variables indicated by "numvar", "timevar", and "notevar" are specified outside a pattern and are global variables. The keyword "numvar" specifies a general numerical variable. The keyword "timevar" specifies a variable that takes a time value and can be used where a time value is needed. The keyword "notevar" specifies a variable that takes a note value and can be used where a note value is needed.

With numvar, user-defined variables can be added to change a pattern dynamically. For example:

```
numvar drumvol = 90 min 0 max 127
numvar drumpan = 16 min −16 max 16
pattern drums {
   kick snare kick snare,
   volume 0 (drumvol),
   pan (−drumpan) (drumpan);
}
```

Using the present invention, variables can be programmed to change during the playing of the pattern. Consider the following example:

```
numvar scare_factor = 50 min 20 max 70
pattern play {
   intro
   middle1_middle2
   finale
}
pattern Theme {
   pitch ((scare_factor/10) + 1.0)
   tempo (scare_factor + 60)
   volume (scare_factor + 55)
   play*
}
```

The pattern play plays the pattern intro, then plays either the pattern middle1 or the pattern middle2, and finally plays the pattern finale. In the pattern Theme, arithmetic calculations are performed within the parentheses, and the * operator after play indicates that the play pattern is looped continuously. The pitch, tempo, and volume of the Theme pattern are specified according to the user-defined number variable scare_factor.

The above example can be very useful when programming the sound track for a virtual environment or a computer game. As the user advances further in the virtual environment or the computer game, the pitch, tempo, and volume of the music can be increased. For example, the pattern middle1 can be:

```
pattern middle1 {
   scary (80 − scare_factor) % |
      very_scary (scare_factor/2) % _
      hairy_scary
}
```

In the above pattern middle1, the weights for the patterns scary, very_scary, and hairy_scary are dependent on the user-defined number variable scare_factor. As the user-defined variable scare_factor is increased, the weight of the pattern scary decreases, and the weights of the patterns very_scary and hairy_scary increase.

Using user-defined variables, random variables can be generated. For example:

```
timevar chirplen = 0.50 − 0.150
notevar chirppitch = '300 − '700
timevar chirpsilence = 1.0 − 3.0
instrument chirp
   sample
      http: ://www.oz.inc/soundlib/natural/birds.ozl: : "Chirp5"
}
pattern Birdsong {
   chirp chirplen '(pitch) *3 @ (chirpsilence),
   chirp chirplen '(pitch) (chirpsilence);
}
```

The above user-defined time variable chirplen and note variable chirppitch each produce a new random variable in the range specified for each instance called. The pattern Birdsong produces the random chirping of two birds.

In addition to defining the reserved variables in user-defined variables with actual values, variables can also be linked dynamically to external signals from sources outside the audio language, such as two dimensional and three dimensional graphical representations.

Audio Scene

Using the audio language of the present invention, an audio scene can be created. In FIG. 5, an exemplary data structure for an audio scene 104 is illustrated, and includes entries for: the audio file ("file") 25; and optional reserved variables 26 for the audio start ("start"), the tempo ("t"), and the swing.

The audio file 25 of the audio scene 104 points to the audio file to be used with the audio scene. The audio file 25 contains one or more patterns for the audio scene and any required variables, samples, instruments, MIDI instruments, and filters. The audio file 25 is identified by a file path name, a file in the virtual reality markup language ("VRML") or VRML2, a file in the hypertext markup language ("HTML"), a stand alone audio scene, or any other representation for pointing to an audio file. An audio file 25 can be mixed with any other audio file according to the prioritization of the audio file and the position of the user within the audio scene.

The reserved variable audio start ("start") refers to the time at which the audio scene begins and can be set at either absolute or relative time. The audio start defaults to 0. As a non-limiting example of absolute time, audio start can be a specific GMT time. As a non-limiting example of relative time, audio start can be the time at which a user interacts in a certain way with the general purpose computer, such as when the user clicks the pointer on an icon or when in a virtual environment the user enters a room.

The tempo ("t") refers to the tempo of the audio scene and is set in beats per minute. The tempo defaults to 120.

The swing refers to the percentage with which sixteenth notes are delayed. The swing is a value from 0 to 100% and defaults to 0%.

Audio Player

Figure 6:
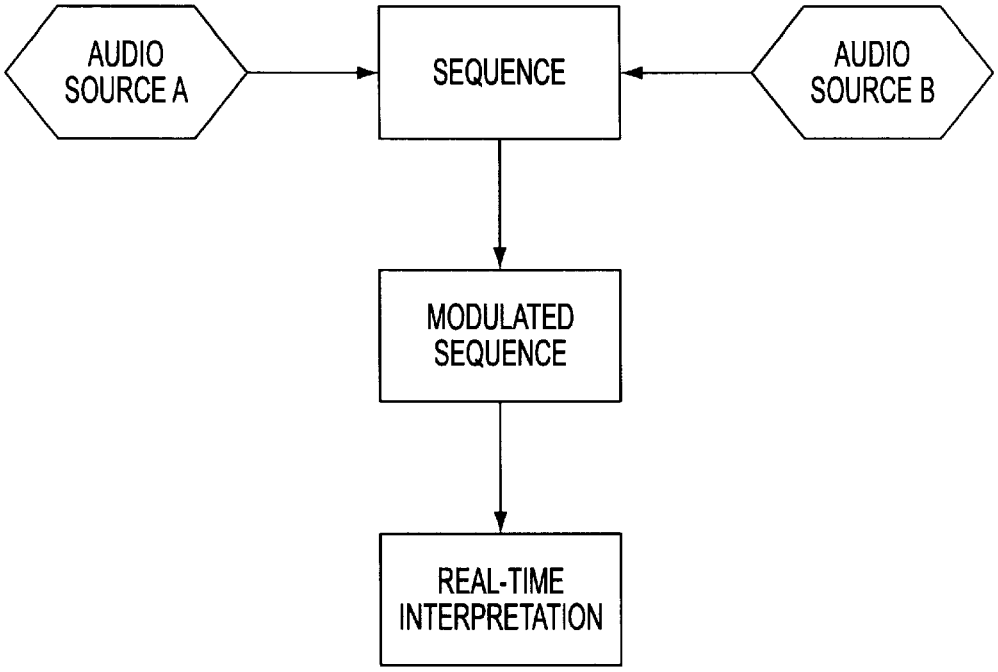
FIG. 6 illustrates a flowchart for sequencing audio sources using the audio player of the present invention.

The audio player of the present invention plays audio files containing code segments for audio sources written in the audio language of the present invention. Further, the audio player is responsible for sequencing, time scheduling, and playing all audio sources for an audio scene. The audio player can also produce a mixed, a synchronized, or a mixed and synchronized playback of audio. For example, in FIG. 6, a flowchart illustrates the process of the audio player for sequencing and modulating two audio inputs.

Figure 7:
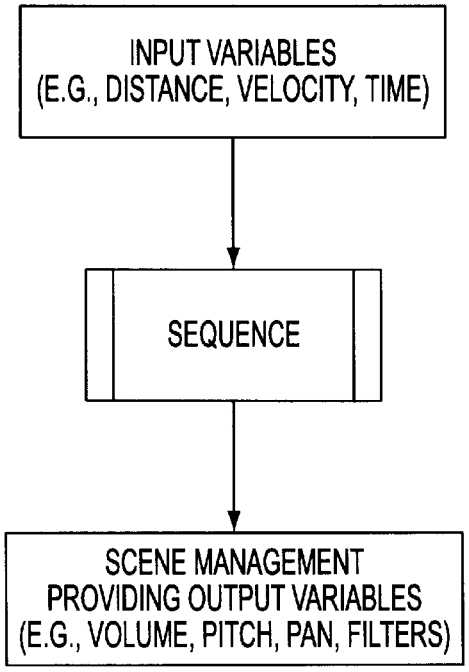
FIG. 7 illustrates a flowchart for managing an audio scene using the audio player of the present invention.

Further, with the audio player, audio scenes can have dynamic behavior, and the audio player manages the audio scenes by sequencing the audio scenes. With the audio player of the present invention, instead of having static behavior where all audio is predetermined and executed in the same way, audio scenes can evolve according to a predetermined sequence or dynamically in response to the user or in response to a random selection. For example, the audio scene can evolve according to a pre-defined rhythm or non-audio triggering events, such as a users' interaction with the general purpose computer and random events. As another example, the audio scene in a virtual environment can evolve according to the user's interaction with the virtual environment, other users' interaction with the virtual environment, or other triggering events. In FIG. 7, a flowchart illustrates the process of the audio player for sequencing and managing an audio scene.

In a preferred embodiment for use with the Internet, dynamic real-time behavior is achieved by embedding the audio player of the present invention in a web page of an Internet site. For example, the audio player can be embedded in a webpage and exposed as a scriptable object using JAVA programs or Active Scripting scripts, being written in languages such as Perl, Visual Basic ("VB"), JavaScript, and Python.

The audio player of the present invention can transfer, play, store, or any combination of transferring, playing, and storing the audio data of the audio sources of an audio scene. In so doing, the audio player prioritizes and sequences the audio sources. By prioritizing and sequencing audio sources, efficient playing, transferring, and storing of the audio data is achieved. Further, the user's impression of the audio of the audio scene is enhanced by the prioritization. For example, when an audio scene having numerous audio sources is transferred over a network to a user, the user's impression of the audio of the audio scene is enhanced using the prioritization of the present invention. This is a discovery of the inventor, and the theory behind the audio player of the present invention.

Figure 8:
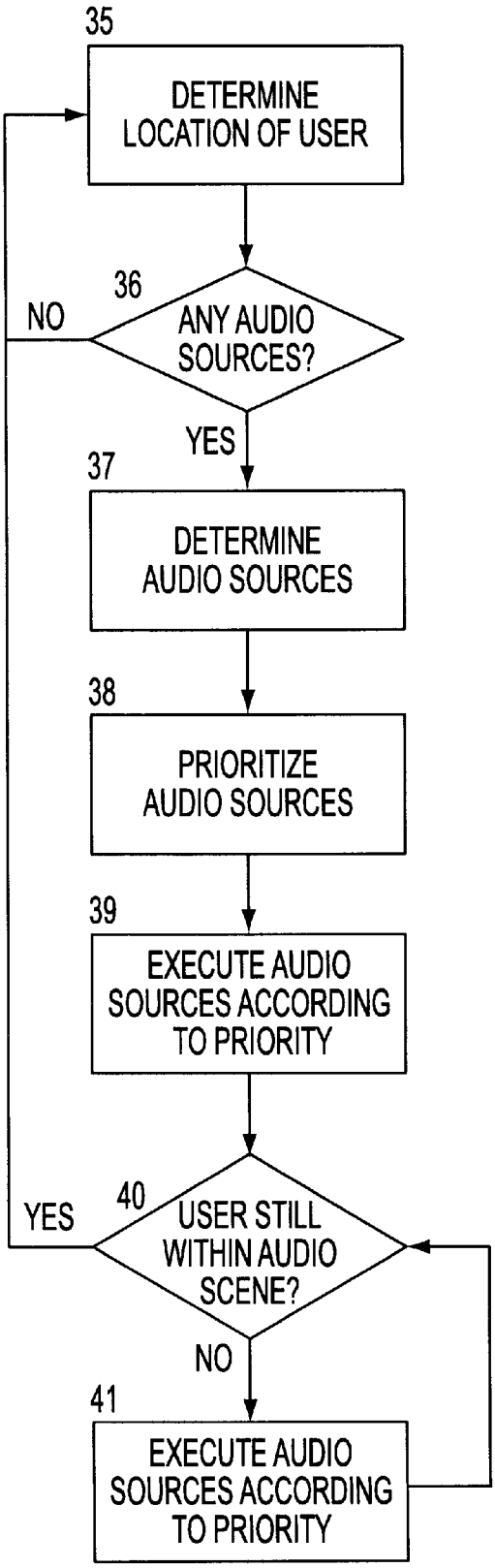
FIG. 8 illustrates a procedure of the present invention for prioritizing audio data.

In FIG. 8, the process used by the audio player of the present invention to prioritize audio sources in an audio scene is illustrated. In block 35, the location of a user with respect to the audio scene is determined. In a preferred embodiment, the user's location is determined by an interaction point between the user and the audio scene. As a non-limiting example, if the audio scene is represented by an area on the monitor of a general purpose computer, the interaction point can be the point at which the user moves a cursor into the area. As another non-limiting example, if the audio scene is represented by a room in a virtual environment, the interaction point can be the user entering the room in the virtual environment.

In block 36, it is determined whether there are any audio sources audible by the user at the user's location determined in block 35. For example, this can be determined by the decibel strength of the audio source at the position of the user. If there are no audio sources audible, the flow proceeds back to block 35. If there are audio sources audible, the flow proceeds to block 37.

In block 37, the audible audio sources are determined. In a preferred embodiment, this is accomplished by determining volume in accordance to position.

In block 38, the audio sources determined in block 37 are prioritized. In a preferred embodiment, this is accomplished by comparing the prioritization reserved variables for each of the audio sources. For example, the prioritization can be based on any of the following reserved variables: priority ("p"); level of loading ("lol"); level of storing ("los"); level of quality ("loq"); and position ("pos").

In a preferred embodiment, each audio scene has one prioritization reserved variable. If the prioritization reserved variable is priority ("p"), the audio sources with a higher priority are the first to be rendered.

If the prioritization reserved variable is level of loading ("lol"), the audio sources with a higher level of loading are the first to be loaded over the network.

If the prioritization reserved variable is level of storing ("los"), the audio sources with a lower level of storing are discarded off the hard disk before audio sources with a higher "los."

If the prioritization reserved variable is level of quality ("loq"), the audio sources with a lower level of quality are played back with lower quality than sources with higher "loq."

If the prioritization reserved variable is position ("pos"), the sources nearest to the listener are the preferred sources.

Alternatively, each audio source in an audio scene can have more than one prioritization reserved variable. In this case, an order of comparing the prioritization reserved variables is used to determine the priority. In a preferred embodiment, this order of priority is: priority ("p"); level of loading ("lol"); level of storing ("los"); level of quality ("loq"); and position ("pos"). A comparison among the priority ("p") for each audio source is made. If a prioritization cannot be determined, a comparison is made using the next variable, namely level of loading ("lol"). If a prioritization of the audio sources cannot be made using the priority ("p") and level of loading ("lol") reserved variables, a comparison is made using the next variable in the order of variables, namely the level of storing ("los"). This process continues until the audio sources of the audio scene are prioritized. If the audio sources cannot be prioritized using the prioritization reserved variables, a random selection is made among the audio sources that cannot be prioritized to place all the audio sources in a prioritization.

As an alternative to using prioritization reserved variables, the priority of the audio sources in an audio source can be determined according to the audio files containing the audio sources. In a preferred embodiment, one audio source is contained in each audio file, and the audio files are arranged according to an order based on a parameter associated with each audio file. Non-limiting examples of the parameter associated with each audio file include: the name of the audio file; the date of creation of the audio file; and the size of the audio file. Non-limiting examples of an order for listing audio files include: alphabetically using the name of the audio file; chronologically using the date of creation of the audio file; and numerically using the size of the audio file.

For this alternative, the audio sources are prioritized based on the order for listing the audio files. For example, if an audio scene has three audio sources, A, B, and C, if the three audio sources are contained in three audio files "aardvark", "batswing", and "catmeow", respectively, and if the audio sources are prioritized according to a forward alphabetization of the names of the audio files, audio source A is prioritized first, audio source B is prioritized second, and audio source C is prioritized third.

As another alternative to using prioritization reserved variables, the priority of the audio sources in an audio scene can be determined by a random ordering of the audio sources.

As another alternative to using prioritization reserved variables, the priority of the audio sources in an audio scene can be determined by scripts and agents.

In block 39, the audio sources determined in block 37 are executed according to priority determined in block 38. In a preferred embodiment, the audio sources are executed by transferring, playing, storing, or any combination of transferring, playing, and storing. For example, if there are three audio sources prioritized as first, second, and third audio sources, the audio sources can be transferred according to their prioritization and then once received played according to their prioritization.

In block 40, it is determined whether the user has moved from the location determined in block 35. As a non-limiting example, if the audio scene is represented by an area on the monitor of a general purpose computer, the user has moved from the location when the user moves a cursor outside the area. As another non-limiting example, if the audio scene is represented by a room in a virtual environment, the user has moved from the location when the user exits the room in the virtual environment.

If the user has not moved, the flow proceeds to block 41. If the user has moved, the flow proceeds to block 35 to determine the new location of the user. In a preferred embodiment, the determination as to whether the user has moved is accomplished by comparing the user's current position with the last calculated position.

In block 41, the audio sources continue to be executed as determined in block 39. The length of play of the audio sources is determined either by the audio sources themselves or by the user moving. In a preferred embodiment, the length of play of an audio source which is a pattern is determined by the reserved variable length ("l"), or by the reserved variable loop. Alternatively, the length of play can be determined by the length of the audio data file.

In a preferred embodiment, after a set time, the flow proceeds from block 41 back to block 40 to determine if the user has moved. Alternatively, the flow proceeds from block 41 back to block 40 after all the audio sources are executed. As another alternative, the flow proceeds back to block 40 after each audio source is executed, and if the user has not moved, the flow proceeds from block 40 back to block 41 to execute the next prioritized audio source.

Figure 9:
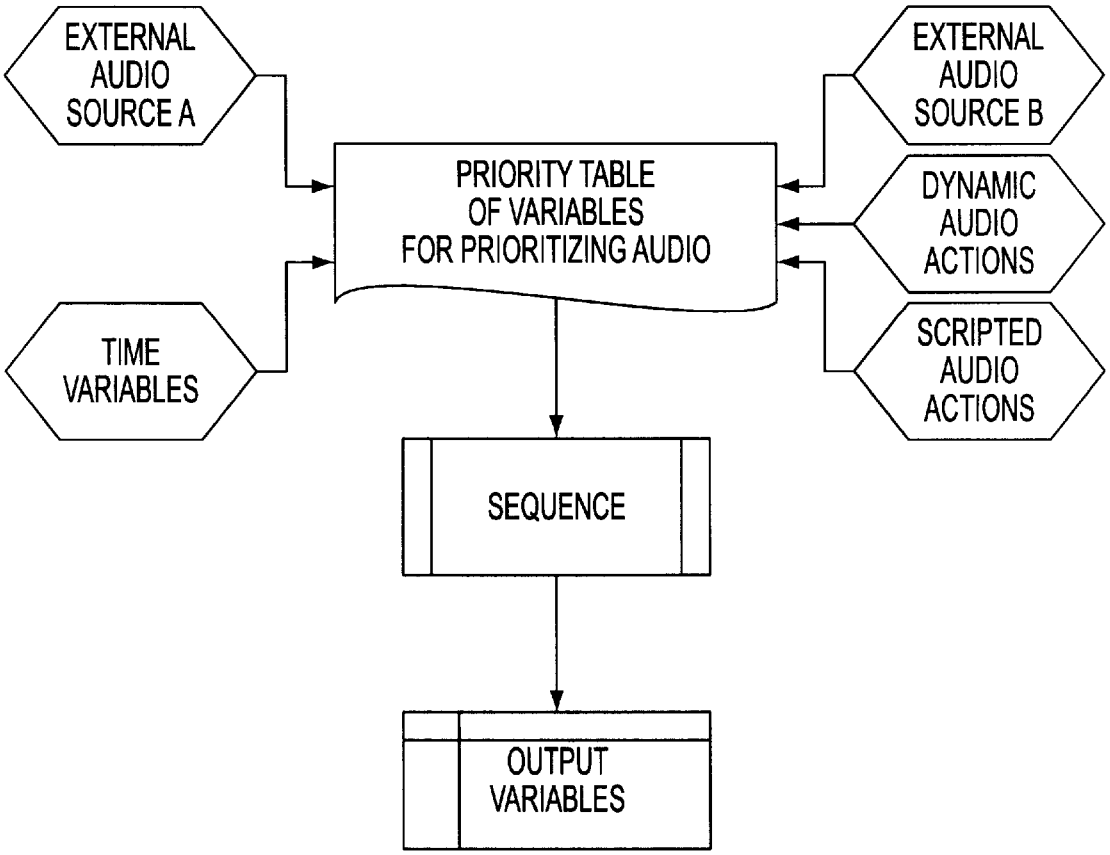
FIG. 9 illustrates multiple audio sources affecting the prioritization of an audio scene.

In FIG. 9, a flowchart illustrates multiple audio sources affecting the prioritization by the audio player of an audio scene.

Figure 10:
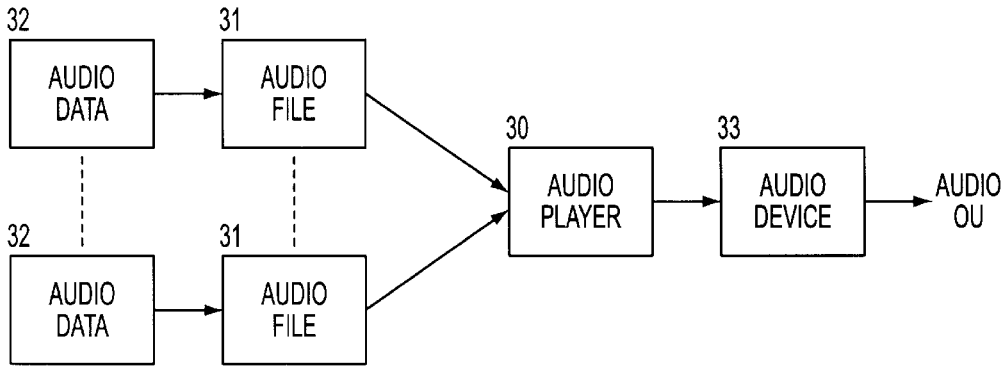
FIG. 10 illustrates the relationship between audio data, audio files, and the audio player of the present invention.
Figure 11:
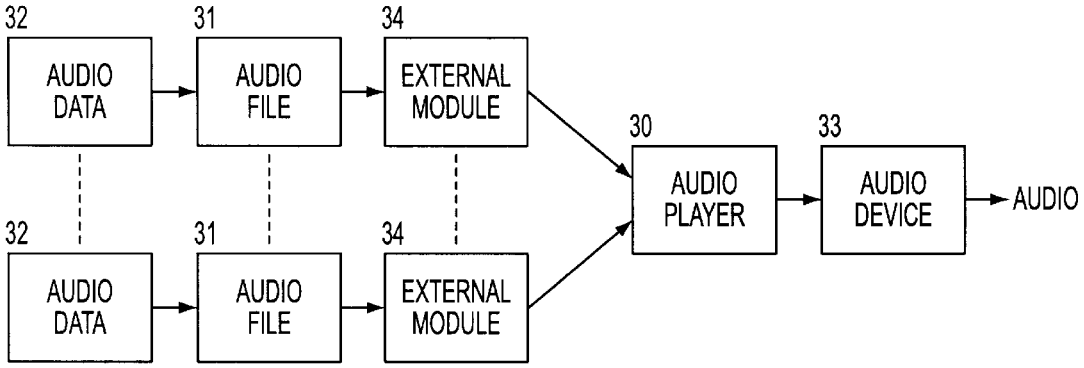
FIG. 11 illustrates an alternative embodiment for the relationship between the audio data, audio files, and the audio player for the present invention.

In FIGS. 10 and 11, the audio player of the present invention is illustrated. In FIGS. 10 and 11, the arrows indicate the direction of audio flow, and do not indicate the direction of all information flow. In FIG. 10, the audio player 30 controls the audio scene. The audio player 30 has the responsibility for sequencing, scheduling, and executing audio sources within the audio scene. The various audio sources within the audio scene are represented by the audio files 31, which are written in the audio language as described above. An audio scene can have zero or more audio sources, and an audio file can have zero or more audio sources. In a preferred embodiment, each audio file contains: one audio source; information as to what the audio source is, such as a pattern; the location of audio source within the audio scene, such as the reserved variable position ("pos"); which event triggers the audio source; and an indication of the priority of the audio source, such as the reserved variable level of loading ("lol")

The audio files 31 can be created using a text editor or by automatically converting standard MIDI files using a converter, which can be a separate utility.

To convert a MIDI file to an audio file using a preferred embodiment, a MIDI parser and a MIDI file-to-audio file translator is required. The MIDI file parser is responsible for loading a binary MIDI file of zeros and ones, parsing the data in the MIDI file into organized sets according to the data type, and sorting the MIDI data into timing order and tracks. The MIDI file-to-audio file translator is responsible for translating the parsed MIDI data into the audio language and writing the translated MIDI data into a new audio file.

The audio files 31 in FIG. 10 access audio data 32. The audio data 32 can be patterns, samples, instruments, MIDI instruments, or filters, as described above for the audio language. The audio data 32 can be located on a computer-readable medium available either locally or over a network to the general purpose computer maintaining the audio player 30. Alternatively, the audio data 32 can be any audio data, whether raw or compressed.

The audio player 30 sequences audio sources by prioritizing the audio sources for execution according to the process of FIG. 8.

In FIG. 10, the audio files 31 and audio data 32 can be located at different Internet sites and located using a uniform resource locator ("URL"). In a preferred embodiment, the transition from one URL having a first audio source to another URL having a second audio source provides seamless audio to the user because audio data can be reused in the script of the audio files access by the URLs. The reusing of audio data can be correlated with the reusing of the images in the .gif and .jpg formats and in the hypertext markup language ("HTML").

The audio player 30 after prioritizing the audio sources in the audio scene transfers the audio sources in a prioritized manner to an audio device 33 for producing audio. In a preferred embodiment, the audio device 33 comprises a sound card and a speaker or a plurality of speakers. Non-limiting examples of the sound card include the SoundBlaster 16, the AWE32, and the AWE64 sound cards. Alternatively, the audio device can comprise any soundcard from other manufacturers which are compatible with the Windows sound system.

In addition to or as an alternative to playing the audio sources through the audio device 33, the audio player 30 can transfer, play, or store, or any combination of transfer, play, and store the audio sources in a prioritized manner as discussed per block 39 of FIG. 8.

In FIG. 11, external modules 34 are added to the illustration of FIG. 10. The audio language of the present invention permits the importing of external modules, such as filters and envelope generators which act as audio signal modifiers. The external modules 34 act as a link between the audio files 31 and the audio player 30 by referring to the audio data 32 and by describing in the audio language of the present invention how the audio data 32 connects to and affects audio scenes. The audio player 30 triggers the external module 34 to modify the audio signal from the audio file 31 before the audio player 30 receives the audio signal from the audio file 31.

Further, the external modules 34 add additional functionality to the playing of audio sources. The external modules 34 can change individual sound buffers, such as modulation or low pass filtering, or add support for a new or existing sound format, such as the .au, .wav, .ra, and .mp2 file formats. With the ability to add external modules 34, an open computer architecture is advantageously obtained and the functionality of the present invention is advantageously increased.

In addition to the above responsibilities, the audio player 30 serves as an audio scene manager. In a preferred embodiment, the audio player 30 is responsible for parsing the audio files 31 to create internal object graphs. The audio player 30 uses the audio source variables to script the audio scene. The audio player 30 connects filters to audio sources and distributes the audio sources to the audio player. The audio player 30 controls preloading and the level of detail, such as the quantity and quality of audio samples, according to the priority of individual samples, memory usage, and position. In a preferred embodiment, the quality of the audio samples is controlled by down sampling and requantizing to minimize memory and processing time during playback. Alternatively, to control the quality of the audio samples, zero-tree coding can be used to first send the most significant bits and then add detail by sending less significant bits.

Figure 12:
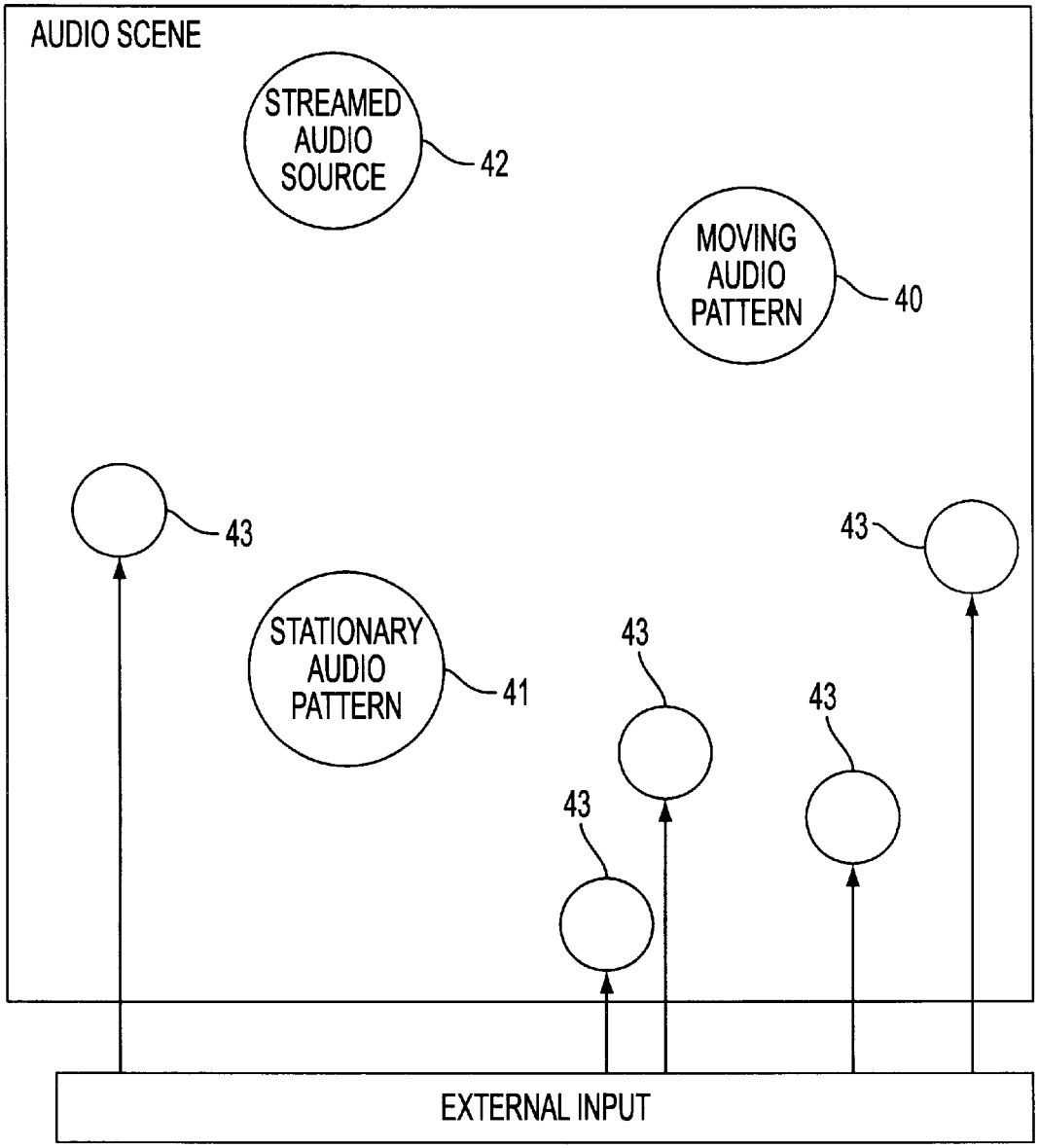
FIG. 12 illustrates audio sources within an audio scene.

In FIG. 12, an example of audio sources within an audio scene is illustrated. The audio scene comprises a moving pattern 40, a static pattern 41, a streamed audio source 42, and several audio sources 43 dependent on external input.

Figure 13:
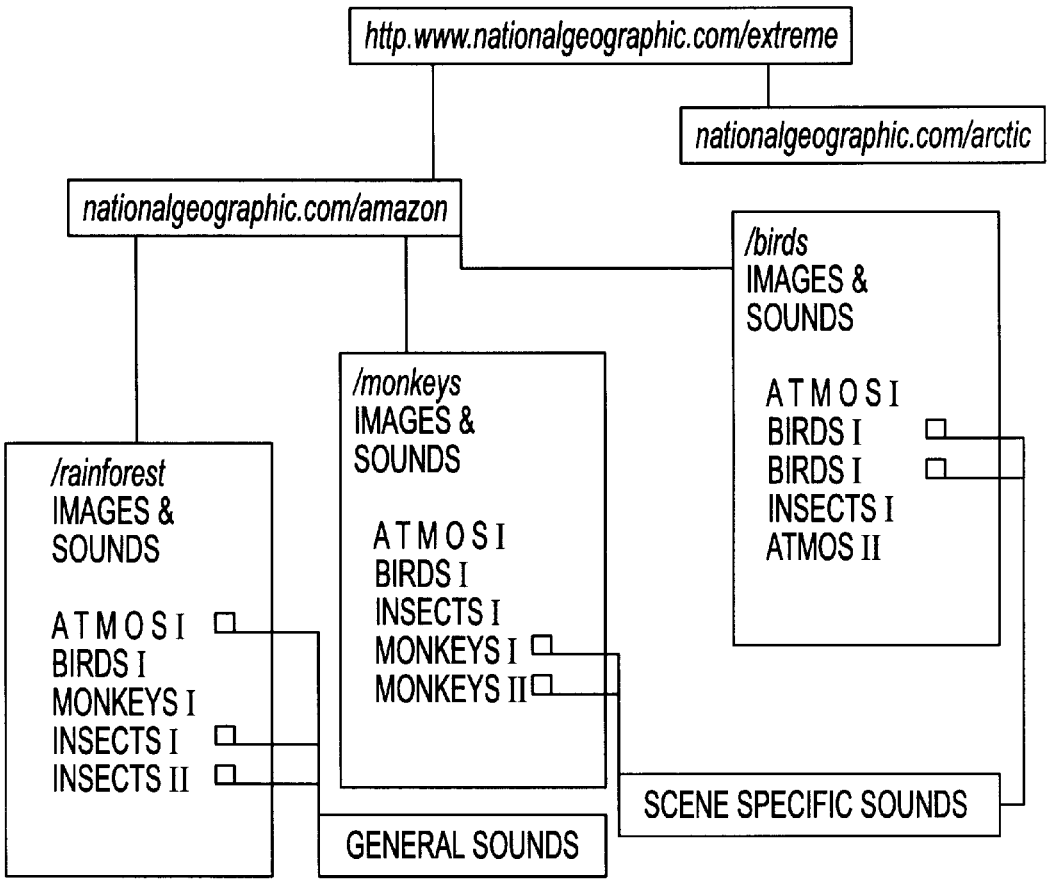
FIG. 13 illustrates sequencing and prioritizing audio data available on an Internet site using the present invention.

In FIG. 13, an example of prioritizing audio sources for use with the Internet is illustrated. In FIG. 13, the audio sources for an audio scene are contained in audio files, which are available at the Internet site of http://nationalgeographic.com/amazon/monkeys. With the present invention, the audio sources are prioritized for execution. In FIG. 13, priority is based on the order of listing in the "/monkey" directory, and the audio sample with highest priority is the one listed first, namely the "AtmosI" file.

In addition to prioritizing and sequencing audio, the present invention can be used to sequence and prioritize other types of data, such as images.

Alternatively, the present invention can be used for document retrieval and storage of audio data using the parameter level of loading ("los"), as described above.

As the invention has been described in detail with respect to the preferred embodiments, it will now be apparent from the foregoing to those skilled in the art that changes and modifications may be made without departing from the invention in its broader aspects. The invention, therefore, as defined in the appended claims, is intended to cover all such changes and modifications as fall within the true spirit of the invention

What is claimed is:

1. A computer-readable medium embodying code segments describing an audio source of an audio scene according to an audio language comprising:

a first code segment for describing audio in the audio source of the audio scene and for dynamically evolving the audio scene; and a second code segment for determining a priority of execution of the audio source within the audio scene;

wherein the second code segment comprises at least one of:

a prioritization reserved variable for determining the priority of execution of the audio source within the audio scene, the prioritization reserved variable comprising one of a priority reserved variable, a level of loading reserved variable, a level of storing reserved variable, a level of quality reserved variable, and a position reserved variable; and a parameter for determining the priority of execution of the audio source within the audio scene, the parameter associated with embodying the code segments describing the audio source on the computer-readable medium;

wherein the audio source is executed to produce audio determined from the first code segment according to the priority of execution determined from the second code segment.

2. A computer-readable medium according to claim 1, wherein the first code segment comprises at least one of audio data for a composed phrase of music, audio data for an audio sample, audio data for a special effect sound, and audio data for audio information.

3. A computer-readable medium according to claim 1, wherein the first code segment comprises:

a pattern data structure for describing audio in the audio source of the audio scene, wherein the pattern data structure comprises:

an audio event; and at least one reserved variable having a default value.

4. A computer-readable medium according to claim 3, wherein the at least one reserved variable of the pattern data structure comprises at least one of an audio source reserved variable, a volume reserved variable, a pan reserved variable, a pitch reserved variable, a length reserved variable, a tempo reserved variable, an articulation reserved variable, a frequency modulation reserved variable, and a waveform modification reserved variable.

5. A computer-readable medium according to claim 3, wherein the pattern data structure further comprises at least one user-defined variable.

6. A computer-readable medium according to claim 1, wherein the first code segment comprises:

a sample data structure for describing audio in the audio source of the audio scene, wherein the sample data structure comprises:

a name for a first file containing audio samples; and at least one reserved variable having a default value and for sampling the audio samples.

7. A computer-readable medium according to claim 6, wherein the at least one reserved variable of the sample data structure comprises at least one of a bass note reserved variable and a loop points reserved variable.

8. A computer-readable medium according to claim 1, wherein the first code segment comprises:

an instrument data structure for describing audio in the audio source of the audio scene as an instrument, wherein the instrument data structure comprises:

a name for a second file having audio data for sampling; and at least one reserved variable having a default value and for adjusting the pitch range of the audio data of the second file.

9. A computer-readable medium according to claim 8, wherein the at least one reserved variable comprises one of a bottom reserved variable, a top reserved variable, and a sensitivity reserved variable.

10. A computer-readable medium according to claim 8, the instrument data structure further comprises:

another reserved variable for describing the attack, sustain, and release of the audio of the instrument data structure.

11. A computer-readable medium according to claim 8, wherein the instrument data structure further comprises at least one module for modifying the audio data of the second file.

12. A computer-readable medium according to claim 1, wherein the first code segment comprises:

a musical instrument digital interface ("MIDI") instrument data structure for describing the audio in the audio source of the scene as an instrument according to MIDI, wherein the MIDI data structure comprises:

a MIDI device identification reserved variable;

a MIDI channel number reserved variable; and a MIDI program number reserved variable.

13. A computer-readable medium according to claim 1, wherein the first code segment comprises at least one variable, wherein the audio scene is dynamically evolved by varying the at least one variable of the first code segment.

14. A computer-readable medium according to claim 13, wherein the at least one variable of the first code segment is varied according to a triggering event.

15. A computer-readable medium according to claim 14, wherein the triggering event comprises a user interaction.

16. A computer-readable medium according to claim 1, wherein the code segments further comprise:

a third code segment for describing the audio scene and for identifying audio sources within the audio scene.

17. A computer-readable medium according to claim 16, wherein the third code segment comprises:

an audio scene data structure for describing the audio scene and for identifying audio sources within the audio scene, wherein the audio scene data structure comprises:

a name for an audio file containing the audio source; and an audio start reserved variable for indicating a beginning of the audio scene.

18. A computer-readable medium according to claim 1, wherein the audio scene is part of a virtual environment.

19. A computer-readable medium according to claim 1, further comprising a fourth code segment for executing the audio source within the audio scene.

20. A process for storing code segments on a computer-readable medium, comprising the steps of:

storing a first code segment according to claim 1 on the computer-readable medium; and storing a second code segment according to claim 1 on the computer-readable medium.

21. A method for generating audio for an audio scene having a plurality of audio sources, the method comprising the steps of:

determining the plurality of audio sources within the audio scene;

prioritizing the plurality of audio sources within the audio scene to obtain a priority of audio sources;

executing the plurality of audio sources according to the priority of audio sources; and processing an interaction by a user with the audio scene.

22. A method according to claim 21, the method further comprising the step of:

determining a location of the user with respect to the audio scene.

23. A method according to claim 21, the method further comprising the step of:

determining the plurality of audio sources with respect to the user.

24. A method according to claim 21, the method further comprising the step of:

continuing to execute the plurality of audio sources until the user is no longer interacting with the audio scene.

25. A method according to claim 21, wherein each audio source of the plurality of audio sources comprises a prioritization reserved variable, and wherein the plurality of audio sources are prioritized according to the prioritization reserved variable of each audio source of the plurality of audio sources.

26. A method according to claim 21, wherein the prioritization reserved variable of each audio source comprises one of a priority reserved variable, a level of loading reserved variable, a level of storing reserved variable, a level of quality reserved variable, and a position reserved variable.

27. A method according to claim 21, wherein executing the plurality of audio sources comprises at least one of transferring, playing, and storing the plurality of audio sources.

28. A method according to claim 21, wherein the audio scene is part of a virtual environment.

29. An apparatus for generating audio for an audio source of an audio scene, the apparatus comprising:

an audio file for describing the audio source of the audio scene in an audio language and for describing a priority of the audio source within the audio scene, the audio file being stored on a computer-readable medium, the audio file comprising means for accessing audio data over a network; and an audio player for accessing the audio file, for determining a priority of audio sources within the audio scene by using the priority of the audio source, and for executing the audio file according to the priority of audio sources within the audio scene.

30. An apparatus according to claim 29, wherein the audio player further comprises means for executing the audio file by at least one of transferring, playing, and storing the audio source.

31. An apparatus according to claim 29, the apparatus further comprising an external module for coupling the audio file to the audio player.

32. A computer-readable medium embodying code segments describing an audio source of an audio scene according to an audio language comprising:

a first code segment for describing audio in the audio source of the audio scene and for dynamically evolving the audio scene;

a second code segment for determining a priority of execution of the audio source within the audio scene; and a third code segment for describing the audio scene and for identifying audio sources within the audio scene;

wherein the audio source is executed to produce audio determined from the first code segment according to the priority of execution determined from the second code segment.

* * * * *